United States Patent [19]

Kristoffersen

[11] 4,012,797

[45] Mar. 22, 1977

[54] SITTING-SQUATTING WATER CLOSET

[75] Inventor: Bjorn R. Kristoffersen, Kirkland, Wash.

[73] Assignee: The Boeing Company, Seattle, Wash.

[22] Filed: Mar. 3, 1976

[21] Appl. No.: 663,587

[52] U.S. Cl. ..... 4/10; 4/254

[51] Int. Cl.[2] ..... E03D 11/00

[58] Field of Search ..... 4/1, 254, 69, 76, 78, 4/239, 10

[56] References Cited

UNITED STATES PATENTS

| | | | |
|---|---|---|---|
| 1,243,148 | 10/1917 | Erwin | 4/254 |

FOREIGN PATENTS OR APPLICATIONS

| | | | |
|---|---|---|---|
| 842,422 | 3/1939 | France | 4/254 |
| 463,664 | 8/1928 | Germany | 4/254 |

*Primary Examiner*—Robert I. Smith
*Attorney, Agent, or Firm*—H. Gus Hartmann

[57] ABSTRACT

A single water closet or toilet fixture for dual functional use as either a western style fixture wherein the user is in the sitting position and normally facing forward, or an eastern style fixture wherein the user is in the squatting position and facing either in the forward direction or the aft direction depending on the embodiment utilized. An external footrest is provided on each side of the fixture for supporting the user in the squatting position. A movable toilet seat when folded down onto the lower bowl portion of the toilet fixture is proportioned for use in the sitting position; and when the toilet seat is raised to an upright position, a fore and aft elongated receptical or bowl portion is exposed which is relatively narrow in width for straddling and is proportioned for use in the squatting position. Also, formed integral with the bowl portion of the fixture, is a urine spray shield which nestles under the contoured toilet seat and is functional in both the sitting and the squatting positions. The necessary height difference between the two function positions of sitting and squatting is incorporated into the height or thickness of the movable seat, in order that fixture can be made low enough to squat on without bodily supporting contact with the user and high enough to sit on.

22 Claims, 10 Drawing Figures

Fig. 1
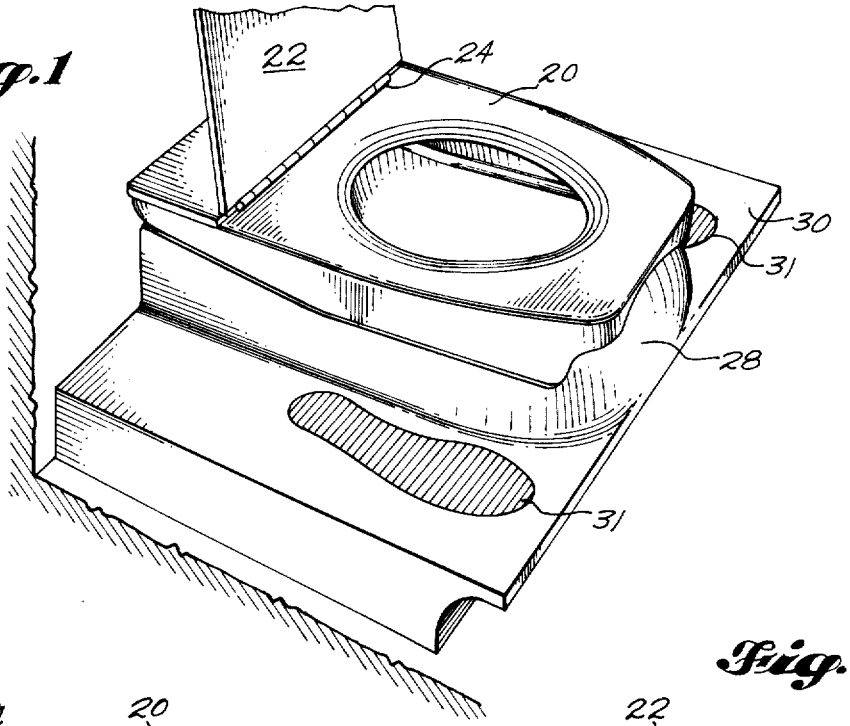
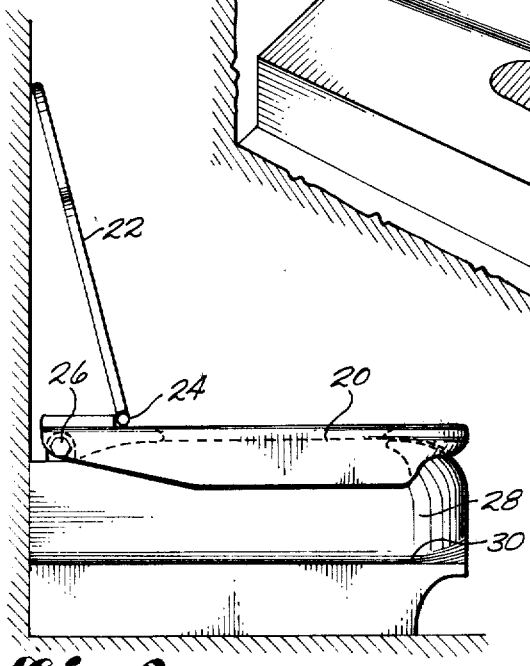
Fig. 2
Fig. 3
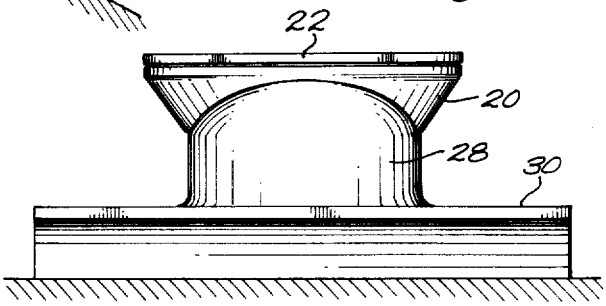
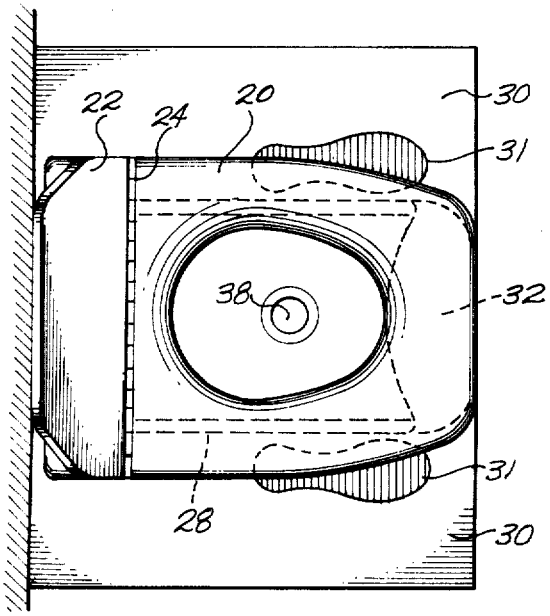
Fig. 4
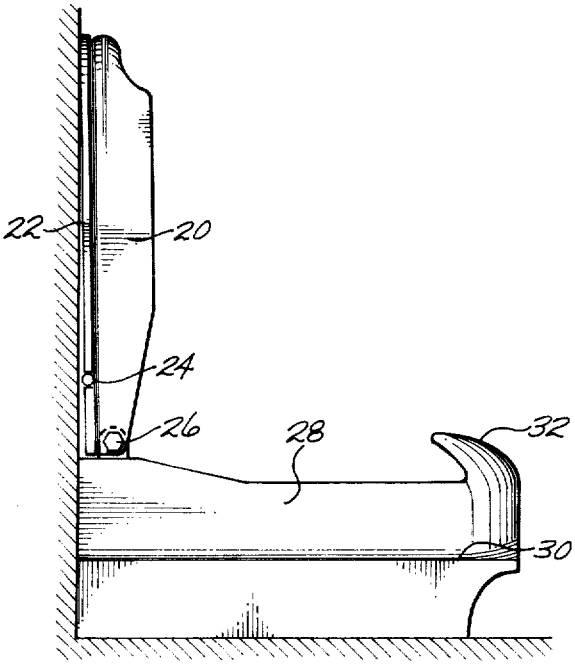
Fig. 5

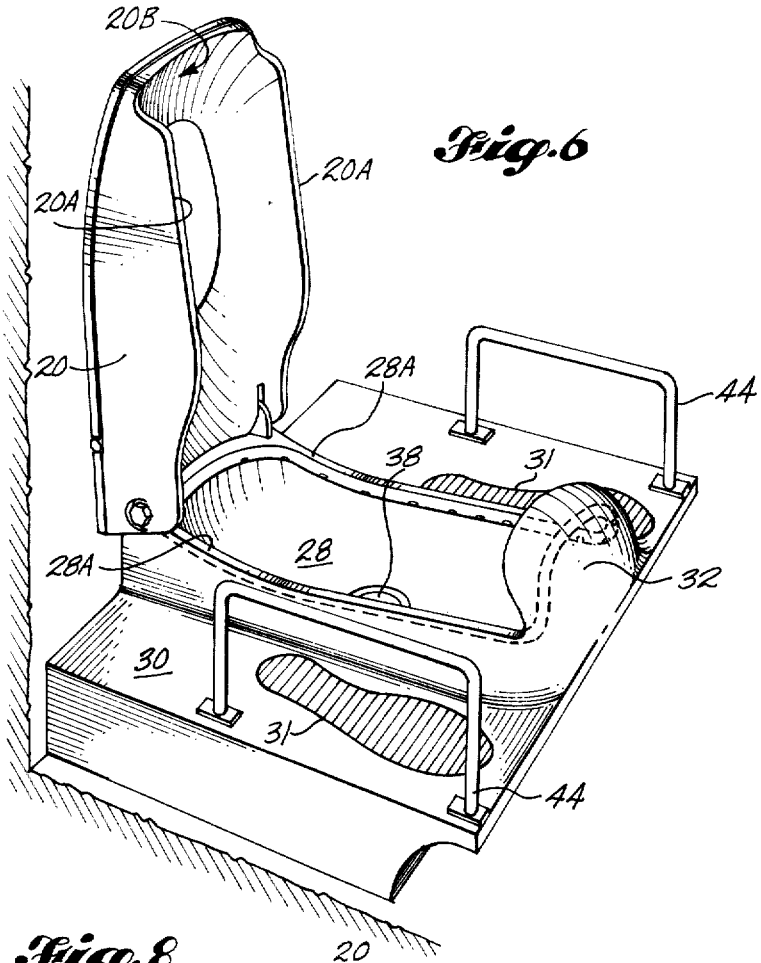
Fig. 6
Fig. 8
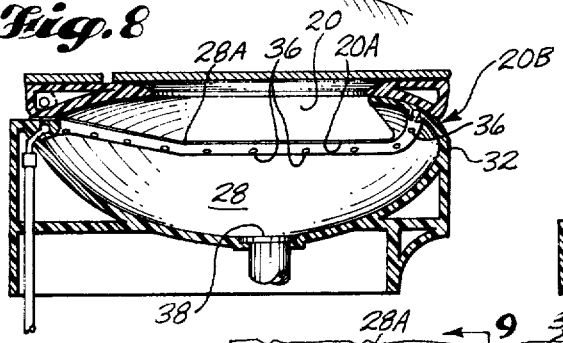
Fig. 9
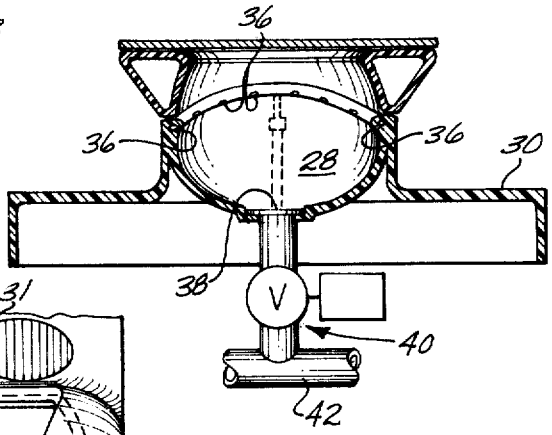
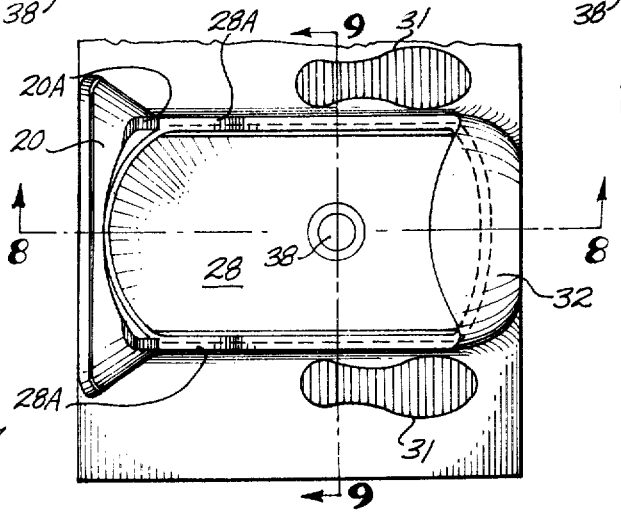
Fig. 7

SITTING-SQUATTING WATER CLOSET

SUMMARY OF THE INVENTION

The invention relates to a water closet or toilet fixture for an aircraft vacuum waste disposal system which is intended for use by persons of either occidental or oriental cultural backgrounds; i.e., a western style fixture for use in the sitting position, and an eastern style fixture for use in the squatting position.

More particularly, the toilet fixture is constructed such that with the lid in the raised position it has the outward appearance of a conventional western style water closet; in that, it is similarly proportioned by having the correct height from the floor for sitting down, which is approximately 14 to 15 inches as measured from the floor to the top of the seat. Further, it is provided with a movable seat which is raised to expose a fore and aft elongated receptical or bowl portion which is proportioned for use by a person in the squatting position. Also, in order to permit the person to assume a functional squatting position, an external platform is provided on each side of the elongated receptical for a footrest.

Although the toilet fixture is designed primarily for use with an aircraft vacuum flush system, it can be adapted for use with a regular gravity flush water system; and in all respects, can be used as a conventional water closet in a home installation when hooked up to a sewer line and water supply line. For the home installation, the deposited waste is removed by flush nozzles within the interior periphery of the bowl portion of the receptical, which moves the waste to a gravity drain outlet. Alternatively, the bowl portion could have standing water or a water trap with a regular gravity water system for flushing the waste out through the drain outlet.

The object of the present invention is to provide a single toilet fixture which is geometrically proportioned to provide the dual toilet facility function that is necessary for utilization by persons of either occidental or oriental cultural backgrounds, i.e. a western style toilet fixture for use in the sitting position and an eastern style fixture for use in the squatting position. In many public places, such as railroads and hotels where a cross-cultural type of influence exists, dual toilet facilities have been necessary; with one being labled "Western Style" and the other "Eastern Style."

Another object is to provide an adequate area in the fore and aft dimensions of the receptical when the toilet fixture is used in the squatting position. From past experience of commercial airlines with the problem of cross-cultural hygienic customs, and more particularly with persons of eastern culture being unwilling to sit down onto the seat portion of the conventional western style fixture in the toilet compartment of the airplane, and instead, trying to assume a squatting position by climbing on top of the seat schroud, which is really not designed for it, and attempting to position themselves above the toilet opening, the result has been dramatically unsatisfactory, in that they have gotten all of the compartment walls, floor, and everything else in the compartment soiled. The results clearly demonstrated, that in order to assume the squatting position, a greater dimension in the fore and aft direction of the normal western style toilet bowl opening was necessary, and that it was just not enough to raise the seat up, because it was still too short and the people were normally overshooting the runway, so to speak. Therefore, through tests and measurements, it has been determined that more than twice the length of the normal exposed bowl opening size of a conventional western style toilet is necessary for achieving satisfactory results.

One of the advantages of the present invention is that the toilet fixture can be easily converted from one cultural style to another, merely by raising or lowering of the seat portion of the fixture.

Another advantage is that the necessary height difference between the two functional positions of squatting and sitting is incorporated into the movable or foldable seat portion of the toilet fixture. Generally, in the prior art toilet fixtures which attempted to combine the functional features of squatting and sitting, into a unitary toilet fixture: when the fixture was made low enough to squat on, it was too low to sit on; and when it was made high enough to sit on, it was too high to squat on.

BRIEF DESCRIPTION OF THE DRAWINGS

FIG. 1 is a perspective view of a preferred embodiment of the toilet fixture in accordance with the present invention showing it with the lid or toilet seat cover in the raised position for use of the fixture in the forward facing sitting position.

FIG. 2 is a side view of FIG. 1.

FIG. 3 is a front view of FIG. 1.

FIG. 4 is a plan view of FIG. 1.

FIG. 5 is a side view of FIG. 1 with the toilet seat in the raised position.

FIG. 6 is a perspective view similar to FIG. 1 with the seat in the raised position and the inclusion of side hand grips attached to the footrests.

FIG. 7 is a plan view of FIG. 6.

FIG. 8 is a side sectional view taken in the direction indicated by 8—8 of FIG. 7.

FIG. 9 is a front sectional view taken in the direction indicated by 9—9 of FIG. 7.

DESCRIPTION OF THE PREFERRED EMBODIMENTS

Figure 10:
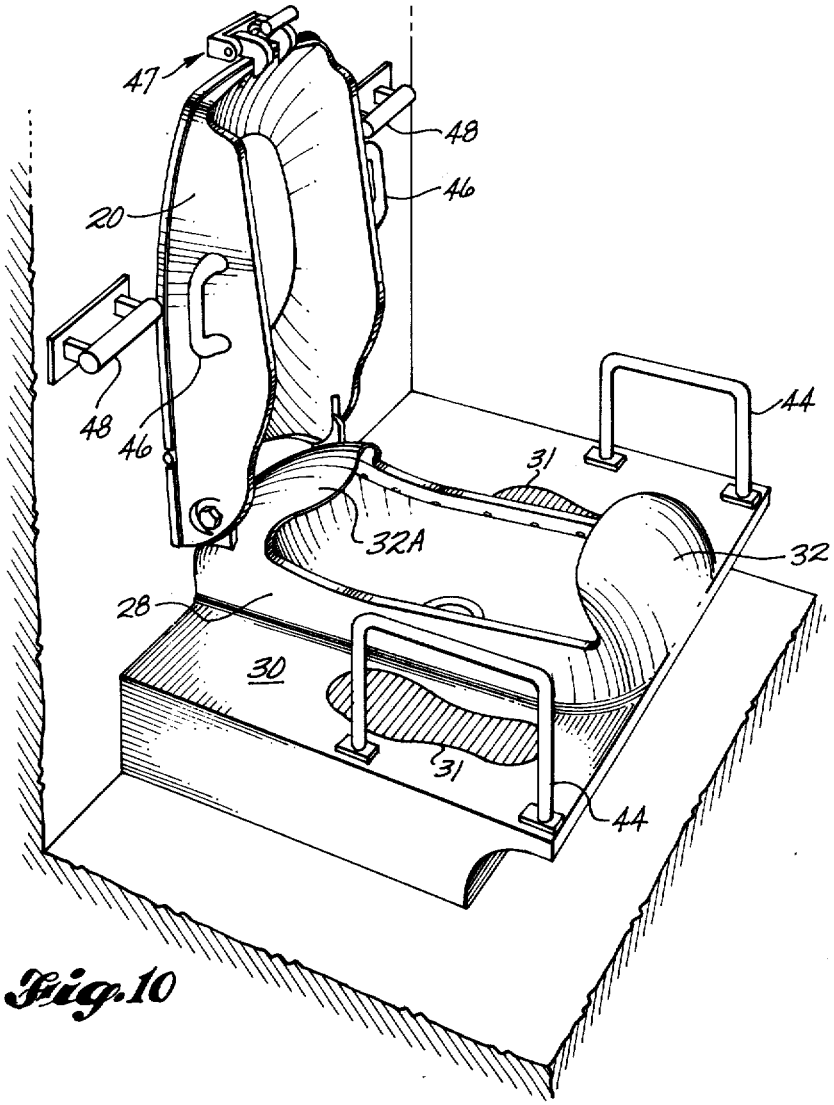
FIG. 10 is a perspective view of a second embodiment of the toilet fixture in accordance with the present invention, showing it with the toilet seat in the raised position, exposing dual urine spray shields for fore or aft facing use of the fixture in the squatting position, in addition to alternative locations of hand grips for supporting the user in the squatting position.

FIGS. 1 – 9 show the preferred embodiment of the invention comprising a water closet or toilet fixture having a movable seat 20 and lid 22, for providing a dual cultural convenience. With the lid 22 raised and the seat 20 in the down position, the toilet fixture has a general outward appearance of a conventional western style toilet fixture. The toilet fixture should be designed dimensionally for those persons falling between 5% to 95% percentile statistics for the United States.

Referring now to some of the details of the preferred embodiment shown in FIGS. 1 – 9, the toilet fixture comprises a lid 22 which is hinged at 24 to the seat 20; and a seat 20 which is hinged at 26 to a lower bowl or receptical 28. The lid 22 is hinged to the seat 20 along a hinge axis 24 which is not in common with the hinge axis 26 of the seat 20; rather, the lid hinge axis 24 is spaced forward and parallel to the seat hinge line 26, in order that the lid 22 will not have a tendency to fall forward when the seat is raised and the lid being in the up position. Further, as more clearly seen in the side view of FIG. 5, the seat 20 is hinged at 26 to the lower bowl portion 28 such that when it is in the raised position, its center of gravity passes over-center of the hinge line 26, so as to remain in the upright position; or through an over-center type of hinging mechanism (not shown) which operates to retain the seat 20 and lid 22 in the raised position. With the seat 20 in the raised position, a trough or an elongated bowl shaped receptical 28 is exposed; and it should be noted, that the bottom of the trough as shown in FIG. 9, is actually below the level of the horizontal surface of the side footrests or platform 30. The interior bottom surface of the receptical 28 must be below the horizontal plane of the footrests in order that there is sufficient clearance between the deposited waste and the body of user; and approximately 2 inches or more below the horizontal footrest plane is required.

The sides of the receptical 28 are much lower in height than the exposed bowl sides of a conventional western style toilet fixture, in order that the proper geometrical proportions are provided for an average sized person assuming the squatting position, so that he does not contact the sides when in the squat position. For use in the squat position, the height of the sides of the receptical above the horizontal plane of the footrests, should be no more than 4 inches in order to prevent body contact with the sides of the receptical. Further, for use in the squat position, if the overall external width of the fixture is too wide, it is difficult or in some cases impossible to assume the proper squat position. This straddle width of the receptical 28 should be less than 10 inches, with the optimum being approximately 8 to 9 inches. However, for use in the seated position, the width of the seat 20 should be approximately 15 inches or approximately 1½ times the straddle width of the receptical 28; and the width of the seat opening should be limited so as to be retained within the interior width of the lower receptical 28, i.e. approximately 8½ inches wide by 10½ inches in length with a round opening being preferable.

The front portion of the receptical 28 is formed integral with an upward and inward projecting member or urine spray shield 32 for deflecting the urine from going outside of the receptical and onto the floor. The interior surface is of concave curvature which merges in a streamlined manner with the inner curvature of the main body of the closet bowl, as is more clearly shown in FIG. 8, and this interior curvature is of an elliptical curvilinear curvature which functions to receive and direct the urine into the body of the recepticle without deflecting it back onto the person.

The undersurface of the seat 20 is made so that it follows the contour around the lower receptical 28; i.e. the downward projecting edge 20A along the undersurface of the seat engages and rests against the rim or upper edge 28A of the sides of the receptical 28. However, the front undersurface 20B of the seat is contoured in order that when it is in the down position, as shown in FIG. 8, it does not necessarily rest on or contact the spray shield 32, but rather nestles over it. When the seat 20 is in the down position, the sides and the flanged undersurface 20A functions as a skirt or apron over the receptical bowl 28 to cover it and contain the waste matter so that the spatter or spray does not get to the outside.

The seat thickness or skirt is a major portion of the total fixture height, i.e. approximately half of the height between the top of the side footrests and the top of the seat, and this permits the receptical 28 to be made as low as is necessary for proper clearance in the squat position. Also, as more clearly seen in FIGS. 3 and 4, the thickness of the seat 20 functions as the transition contour change between the relatively narrow straddle width of the receptical and the comparatively greater width of the seat necessary for sitting thereon. Further, the thickness of the seat 20 permits the nestling or stowage of the spray shield 32 which extends above the height of the sides 28A of the receptical 28. If the toilet fixture is not equipped with the proper sized and contoured spray shield 32, it will not be sanitary for use in straddling position for preventing liquid waste from spraying out onto the floor, or from being deflected back onto the person. Therefore, it has been determined that the height of the spray shield 32 should be approximately 8 inches or more above the horizontal plane of the footrests; and that the interior surface of the shield should be a concavity in order that the urine spray is deflcted back into the receptical without splashing back.

The toilet bowl flushing action can be operated with the seat 20 in either the raised or the lowered position; because, the water flushing action basically takes place in the lower receptical portion 28 of the toilet fixture. Through the actuation of a lever or handle 34 (not shown) the flush mechanism will inject flush water through spray nozzles 36 located within the inner periphery of the receptical as shown in FIGS. 6–9; and wash down the soil and waste through the drain valve outlet 38. The spray nozzles 36 are located on the interior sides of the receptical and also under the front spray shield 32, such that the injected water spray will remove any deposited waste and wash it down to the drain outlet 38.

The toilet fixture is particularly adaptable for use in an aircraft vacuum waste disposal system. A drain valve operating mechanism 40 is connected to the receptical drain outlet 38 and functions to open the outlet to the vacuum pressure drain line 42 before the flush water is injected through the spray nozzles 36 in order that the waste matter can be moved by the water spray and flow, to the drain outlet 38. The drain outlet 38 is located such that with a person situated in either the seated or the squatting position, the waste matter would normally be deposited very close thereto; in order, that the waste matter does not have to be moved any appreciable distance within the receptical unit by the flush water being wasted down the drain outlet 38.

As shown in the figures, the lower receptical 28 of the toilet fixture is formed as one integral unit with side footrests 30 or a type of standing platform on each side. The footprints 31 indicate the relative position of foot placement when a person assumes the squatting position. It has been found that, even if footstools are provided on the sides of a conventional western style toilet fixture, and the person is very careful when using it in the squatting position, it is still inadequate from the standpoint of size and geometry; and is certainly not the sanitary way of doing it. The width of the receptical 28 is important when assuming the squatting position, because for proper balance in assuming the normal squatting position, it is necessary to keep the feet closer together than would be possible in attempting to straddle a conventional western style toilet fixture. This difference in width relationship between the two functional arrangements of the present invention is more clearly shown by the position of the footprints 31 in the plan views of FIGS. 4 and 7; where in straddling the fixture with the seat in the raised position, the feet can be kept closer together.

In some oriental countries, the squatting type toilet fixture is turned around so that what would normally be considered as the front of the fixture faces the wall; because handles are normally mounted on the wall for a person to support himself while assuming the squatting position. Regardless of the arrangement of the toilet fixture with respect to the adjacent structure, it will still be necessary to provide hand grips, in order to make it acceptable for persons assuming the squatting position to support themselves. The toilet fixture of the present invention would probably be used in a compartment or location where hand grips could be mounted onto the wall on one or both sides of the toilet fixture, or on a wall in front thereof; however, for a completely integral toilet fixture, as shown in FIG. 6, hand grips 44 are mounted to the side footrests 30. Also, as shown in the second embodiment, FIG. 10, the hand grips could protrude from the outer sides of the seat member 20 and be utilized for support when the seat is in a raised and locked position by a latch mechanism 47.

In FIG. 10, the receptical 28 also has an upwardly curved urine spray shield 32A in the back, for use in the squatting position when facing aft, or towards the raised seat 20.

By incorporating the seat latching mechanism 47 or a locking feature in the over-center hinging mechanism (not shown), the seat could be utilized as an upright support for hand grips 46 formed integral with the sides of the seat 20; and the advantage of this is that the toilet fixture would not require adjacent support structure for attachment of the hand grips.

Another obvious advantage of this embodiment is that a person may face in either direction when assuming the squatting position; if, in addition to the seat hand grips 46, the side hand rails 44 are provided.

An alternative location for hand grips when facing towards the raised seat could be the wall mounted hand grips 48.

What is claimed is:

1. A dual function water closet for use in either the sitting or the squatting position, comprising: a fixed lower section and a movable upper section foldable thereon; said lower section comprising a closet bowl being elongated in a fore and aft direction; said upper section comprising a toilet set hinged to the aft portion of the closet bowl and being in abutment sealing relationship with the sides of the elongated closet bowl when moved to the down position for use in the sitting position; a footrest fixed to each side of the closet bowl for support of the user in the squat position; said closet bowl having the level of its interior bottom surface below the horizontal plane of the side footrests; a urine spray shield at the forward end of the closet bowl; and said urine spray shield having an outer upper surface which nestles under the forward undersurface of the toilet seat for deflecting the urine of the user into the body of the closet bowl when the user is facing in the forward direction.

2. The water closet as set forth in claim 1, wherein said urine spray shield is formed integral with the body of the closet bowl, and has an interior concave curvature which merges in a streamlined fashion with the inner curvature of the body of the closet bowl and functions to receive and redirect the urine into the body of the closet bowl such that it is not deflected back onto the user.

3. The water closet as set forth in claim 1, wherein: the toilet seat thickness is approximately half of the height difference between the upper surface of the footrests and the top of the toilet seat; whereby, the height difference between the two functional positions of squatting and sitting, is incorporated in the thickness of the movable toilet seat portion of the water closet.

4. The water closet as set forth in claim 1, further including: a drain valve outlet in the bottom of the closet bowl; nozzles mounted under the urine spray shield, and around the interior periphery of the closet bowl; said nozzles being addjusted so as to inject flushing fluid to move deposited waste matter to the drain valve outlet; and said drain valve outlet being positioned within the closet bowl such that the user situated in either the sitting or the squatting position would normally deposit waste matter thereon; whereby, the waste matter does not have to be moved any appreciable distance within the closet bowl by the action of the flush fluid before being removed through the drain valve outlet.

5. The water closet as set forth in claim 1, further including: a urine spray shield at the aft end of the closet bowl for deflecting the urine into the body of the closet bowl when the user is facing in the aft direction.

6. The water closet as set forth in claim 5, further including: means for restraining said movable upper section in the raised position; and a handle fixed to said movable upper section on each side thereof, for support utilization by the user in the squatting position when facing in an aft direction with said movable upper section being restrained in the raised position.

7. A dual purpose water closet for sitting or squatting, comprising: a fixed lower section and a movable upper section foldable thereon; said lower section comprising a closet bowl being of a low-down profile and elongated in a fore and aft direction with upraised sides; said upper section comprising a seat hinged to the rear portion of the closet bowl; said seat being in an abutment sealing relationship along the upper edge of the upraised sides of the closet bowl, when folded down onto said lower section; a footrest on each side of the closet bowl for support of the user in the squat position; said closet bowl having its bottom below the horizontal level of the side footrests; said lower section being for use in a squat position when said upper section is raised; said upper section being for use in a seated position when folded down onto said lower section; a urine spray shield at the forward end of the closet bowl; said urine spray shield having an outer upper surface which nestles under the forward undersurface of the seat for deflecting the urine of the user into the body of the closet bowl when the user is sitting on the toilet seat.

8. The water closet as set forth in claim 7, wherein said urine spray shield is formed integral with the body of the closet bowl, and has an interior concave curvature which functions to receive and redirect the urine into the body of the closet bowl without deflecting it onto the user.

9. The water closet as set forth in claim 7, wherein: the seat thickness is approximately half of the height difference between the upper surface of the footrests and the top of the seat; whereby, the height difference between the two functional positions of squatting and sitting, is incorporated in the thickness of the foldable seat portion of the water closet.

10. The water closet as set forth in claim 7, further including: a drain valve outlet in the bottom of the closet bowl; nozzles mounted under the urine spray shield, and around the interior periphery of the closet bowl; said nozzles being adjusted so as to inject flushing fluid to move deposited waste matter to the drain valve outlet; and said drain valve outlet being positioned within the closet bowl such that the user situated in either the sitting or the squatting position would normally deposit waste matter thereon; whereby, the waste matter does not have to be moved any appreciable distance within the closet bowl by the action of the flush fluid before being removed through the drain valve outlet.

11. The water closet as set forth in claim 7, further including: a urine spray shield at the aft end of the closet bowl for deflecting the urine into the body of the closet bowl when the user is in the squatting position and facing in the aft direction.

12. The water closet as set forth in claim 11, further including: means for restraining the seat in the raised position; and a handle fixed to the seat on each side thereof, for support utilization by the user in the squatting position when facing towards the aft end of the closet bowl with the seat being restrained in the raised position.

13. A dual function use water closet for use in either the sitting or the squatting position, comprising: a closet bowl elongated in a forward and a rearward direction, and having an interior bowl length dimension of at least twice its width; a toilet seat hinged to the rearward portion of the closet bowl, and in abutment sealing relationship with the elongated sides of the closet bowl when folded down onto the closet bowl for use in the sitting position with the user facing in the forward direction; a footrest fixed on each of the elongated sides of the closet bowl for supporting the user in the squatting position; and a urine spray shield at the rearward end of the closet bowl for deflecting the urine into the body of the closet bowl when the user is in the squatting position and facing in the rearward direction.

14. The water closet as set forth in claim 13, wherein said urine spray shield is formed integral with the body of the closet bowl, and has an interior concave curvature for receiving the urine and redirecting it into the body of the closet bowl without deflecting it onto the user when the user is in the squatting position and facing in the rearward direction.

15. The water closet as set forth in claim 13, wherein: the toilet seat thickness is approximately half of the height difference between the upper surface of the footrests and the top of the toilet seat; whereby, the height difference between the two functional positions of squatting and sitting is incorporated in the thickness of the foldable toilet seat portion of the water closet.

16. The water closet as set forth in claim 13, further including: a drain valve outlt in the bottom of the closet bowl; nozzles mounted under the urine spray shield, and around the interior periphery of the closet bowl; said nozzles being adjusted so as to inject flushing fluid to move deposited waste matter to the drain valve outlet; and said drain valve outlet being positioned within the closet bowl such that the user situated in either the sitting or the squatting position would normally deposit waste matter thereon; whereby, the waste matter does not have to be moved any appreciable distance within the closet bowl by the action of the flush fluid before being removed through the drain valve outlet.

17. The water closet as set forth in claim 13, further including: means for restraining the toilet seat in the raised position; and a handle fixed to the toilet seat on each side thereof, for support utilization by the user in the squatting position when facing towards the raised toilet seat and with the toilet seat being restrained in the raised position.

18. The water closet as set forth in claim 13, further including: a urine spray shield at the forward end of the closet bowl; said forward urine spray shield having an outer upper surface which nestles under the forward undersurface of the toilet seat for deflecting the urine into the body of the closet bowl when the user is sitting on the toilet seat and facing in the forward direction.

19. A dual functional use water closet for either the sitting or the squatting position, comprising: a closet bowl elongated in a fore and aft direction, and having an interior bowl length dimension of at last twice its width; a footrest fixed on each of the elongated sides of the closet bowl in a horizontal plane for supporting a person in the squat position; said closet bowl having the level of its interior bottom surface below the horizontal plane of the side footrests for bodily clearance of a person in the squat position, and having an elongated side height above the horizontal plane of the side footrests such that there is no supporting body contact with the person in the squat position; a toilet seat hinged to the aft portion of the closet bowl for movement between a down position to support a person in the sitting position, and a raised position to expose the full interior bowl length dimension of the closet bowl for a person assuming the squatting position; said toilet seat when in the down position, being in abutment sealing relationship with the elongated sides of the toilet bowl for containing the spatter and spray from the deposited waste matter and urine when used by a person in the sitting position; means for restraining the toilet seat in the raised position; and a handle fixed to the toilet seat on each side thereof, for support utilization by a person in the squatting position when facing towards the raised toilet seat and with the toilet seat being restrained in the raised position.

20. A dual functional use water closet for either the sitting or the squatting position, comprising: a closet bowl elongated in a fore and aft direction, and having an interior bowl length dimension of at least twice its width; a footrest fixed on each of the elongated sides of the closet bowl in a horizontal plane for supporting a person in the squat position; said closet bowl having the level of its interior bottom surface below the horizontal plane of the side footrests for bodily clearance of a person in the squat position, and having an elongated side height above the horizontal plane of the side footrests such that there is no supporting body contact with the person in the squat position; a toilet seat hinged to the aft portion of the closet bowl for movement between a down position to support a person in the sitting position, and a raised position to expose the full interior bowl length dimension of the closet bowl for a person assuming the squatting position; said toilet seat when in the down position, being in abutment sealing relationship with the elongated sides of the toilet bowl for containing the spatter and spray from the deposited waste matter and urine when used by a person in the sitting position; and a urine spray shield at the aft end of the closet bowl for deflecting the urine into the body of the closet bowl when the user is in the squatting position and facing in the aft direction.

21. A dual functional use water closet for either the sitting or the squatting position, comprising: a closet bowl elongated in a fore and aft direction, and having an interior bowl length dimension of at least twice its width; a footrest fixed on each of the elongated sides of the closet bowl in a horizontal plane for supporting a person in the squat position; said closet bowl having the level of its interior bottom surface below the horizontal plane of the side footrests for bodily clarance of a person in the squat position, and having an elongated side height above the horizontal plane of the side footrests such that there is no supporting body contact with the person in the squat position; a toilet seat hinged to the aft portion of the closet bowl for movement between a down position to support a person in the sitting position, and a raised position to expose the full interior bowl length dimension of the closet bowl for a person assuming the squatting position; said toilet seat when in the down position, being in abutment sealing relationship with the elongated sides of the toilet bowl for containing the spatter and spray from the deposited waste matter and urine when used by a person in the sitting position; and a urine spray shield at the forward end of the closet bowl; said forward urine spray shield having an outer upper surface which nestles under the forward undersurface of the toilet seat for deflecting the urine into the body of the closet bowl when the user is in the squatting position and facing in the forward direction.

22. The water closet as set forth in claim 21, wherein said urine spray shield is formed integral with the body of the closet bowl, and has an interior concave curvature for receiving the urine and directing it into the body of the closet bowl without deflecting it onto the user when the user is in the squatting position and facing in the forward direction.

* * * * *